United States Patent [19]

Pleass

[11] 4,421,491

[45] Dec. 20, 1983

[54] LINKING SAILBOARDS

[76] Inventor: Charles M. Pleass, Havre de Grace, Md. 21708

[21] Appl. No.: 275,722

[22] Filed: Jun. 22, 1981

[51] Int. Cl.[3] ..... B63B 1/20

[52] U.S. Cl. ..... 441/74; 441/73; 114/90; 46/93

[58] Field of Search ..... 114/39, 61, 40; 441/73, 441/74, 68; 46/93

[56] References Cited

U.S. PATENT DOCUMENTS

| | | | |
|---|---|---|---|
| 2,959,705 | 11/1960 | Leung | 441/73 |
| 3,264,663 | 8/1966 | Owens | 441/73 |
| 3,707,935 | 1/1973 | Rachie | 441/74 |
| 4,082,304 | 4/1978 | Kendrena | 114/39 |
| 4,100,870 | 7/1978 | Prade | 114/39 |
| 4,166,425 | 9/1979 | Kummetz | 114/90 |
| 4,236,476 | 12/1980 | Solf | 441/74 |
| 4,253,209 | 3/1981 | Carn | 114/39 |
| 4,353,321 | 10/1982 | Liv | 114/61 |

FOREIGN PATENT DOCUMENTS

| | | | |
|---|---|---|---|
| 807596 | 4/1951 | Fed. Rep. of Germany | 114/39 |
| 7821533 | 7/1978 | Fed. Rep. of Germany . | |
| 800650 | of 0000 | France | 441/73 |
| 2210974 | 7/1974 | France . | |
| 2436710 | 4/1980 | France . | |
| 652570 | 2/1963 | Italy | 441/73 |
| 2042425 | 9/1980 | United Kingdom | 441/73 |
| 932071 | 7/1963 | United Kingdom | 114/39 |
| 2042425 | 9/1980 | United Kingdom | 441/73 |

*Primary Examiner*—Trygve M. Blix
*Assistant Examiner*—C. T. Bartz
*Attorney, Agent, or Firm*—Connolly and Hutz

[57] ABSTRACT

A sailboard assembly includes at least two sailboards with each sailboard being linked to another sailboard by a flexible rigid link.

17 Claims, 12 Drawing Figures

16
20
30
36
32
28
18
34
38
40
42
46
50
26
48
44
10
54
56
52
16A
20A
58
66
18A
60
64
62
48A
44A
72
74
68
70
76

LINKING SAILBOARDS

BACKGROUND OF INVENTION

In normal sailboard practice, it is difficult to maintain one craft in the vicinity of the other. These crafts are also normally limited to one sail mounted upon a hull which one person can normally carry; the idea is that simplicity and light weight are attractive features. The few "tandem" or multiple sailboards are recognized as being very fast because the air flow from the leading sail can be allowed to act beneficially on the following sail. However, they are too large to be conveniently carried on the top of an automobile and are very cumbersome to maneuver while sailing. In particular, tacking to windward is difficult since the long rigid hull resists quick turns in the water.

BACKGROUND OF INVENTION

An object of this invention is to provide a means for joining two sailboards in such a way that two or more may sail together, making best use of the combined air flow between their sails and having the social benefit of companionship and increased excitement and interest while sailing.

A further object of this invention is to provide such an assembly which is advantageously adapted for utilizing conventional types of sailboards with only minor modifications thereof.

A still further object of this invention is to provide an assembly wherein the components thereof may be easily detached so as to be readily transportable.

In accordance with this invention, at least two sailboards are provided with each sailboard being connected to another of the sailboards by a flexible rigid link through a swivel means so that the sailboards are joined together by the links but spaced from each other to permit the users to individually control each respective sailboard while still obtaining the advantages attendant with joint operation.

In a preferred form of this invention the swivel means comprise freely rotating collars located below the universal joint which connects the mast plug to the deck plug so that each link is connected to the foot of a respective mast. Preferably the collars are made of a rubber-like material having an integral joining pin extending outwardly thereof to which an end of a respective link would be detachably connected.

In accordance with one ramification of this invention, a platform is provided around the mast mounted slightly above the link collar. The platform would be large enough so that the user may stand thereon when desired to assure being out of the way of the link particularly during rapid and rough action. The platform would, however, be small enough so as not to present an obstacle during normal use of the sailboard.

In accordance with a further ramification of this invention, the universal joint for the mast is an integral member molded in three separate sections including two rigid sections separated by a more flexible central section.

THE DRAWINGS

DETAILED DESCRIPTION

Figure 1:
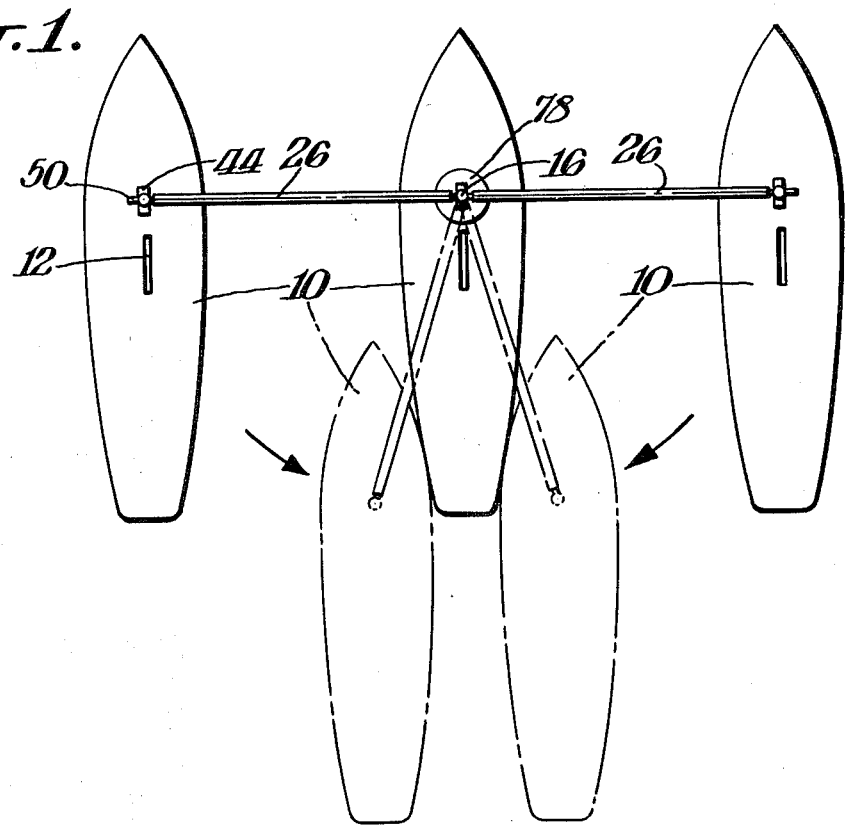
FIG. 1 is a plan view schematically showing three separate sailboards linked together with optional positions indicated in phantom.
Figure 3:
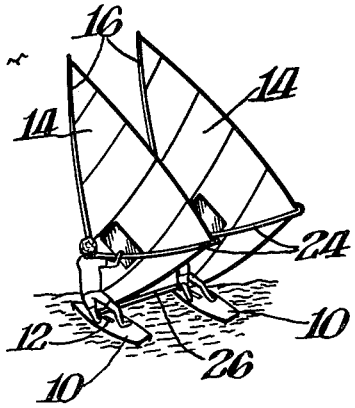
FIG. 3 is a perspective view of an assembly which includes two sailboards linked together in accordance with this invention.

The present invention relates to improvements in sailboards and is particularly useful in its adaptability to conventional sailboards. In general such conventional sailboards include, as shown in FIGS. 1 and 3, a hull 10 with a daggerboard 12 extending downwardly from the hull (see FIG. 11). In such sailboards the sail 14 is secured to a mast 16 which in turn is mounted to the hull by a swivel connection 18 (FIGS. 4–5) which joins the mast plug 20 to a deck plug 44 secured to hull 10. Control of the sailboard by the user is had by manipulating a boom 24 (FIG. 3) secured to the sail 14. Since such sailboards are of known construction, it is not necessary to describe in further detail the structure of the sailboards except as pertains to the present invention.

Figure 2:
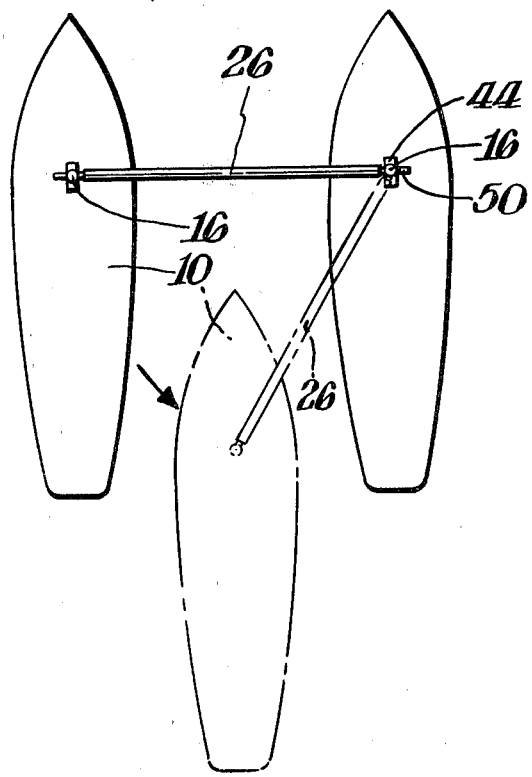
FIG. 2 is a plan view similar to FIG. 1 showing two sailboards linked together.

In general the present invention is based upon the concept of improving the use of conventional sailboards by linking at least two such sailboards together. This is accomplished through a link 26 which is peferably made of a flexible yet rigid material with each end of link 26 being connected to a respective sailboard. Thus, although the sailboards are linked together, they are also spaced from each other and retain a degree of individuality in the manner of operation by the users. FIG. 1, for example, illustrates the application of the concepts of this invention for linking three sailboards together. FIG. 1 shows in solid lines one possible position the sailboards may take with respect to each other and shows in phantom an alternative position. Obviously any number of different positions will be achieved, and it is not necessary, for example, that the sailboards on each side of the intermediate sailboard be in the same relative positions with respect to the intermediate sailboard. One sailboard may be ahead or along side of but spaced from the intermediate sailboard as shown in solid in FIG. 1 while the other sailboard may trail as shown in phantom in FIG. 1. FIG. 2 shows the application of this invention wherein only two sailboards are linked together with different positions being indicated by solid lines and phantom lines.

Figures 4, 5, 6, 7, 8, 9, 10:
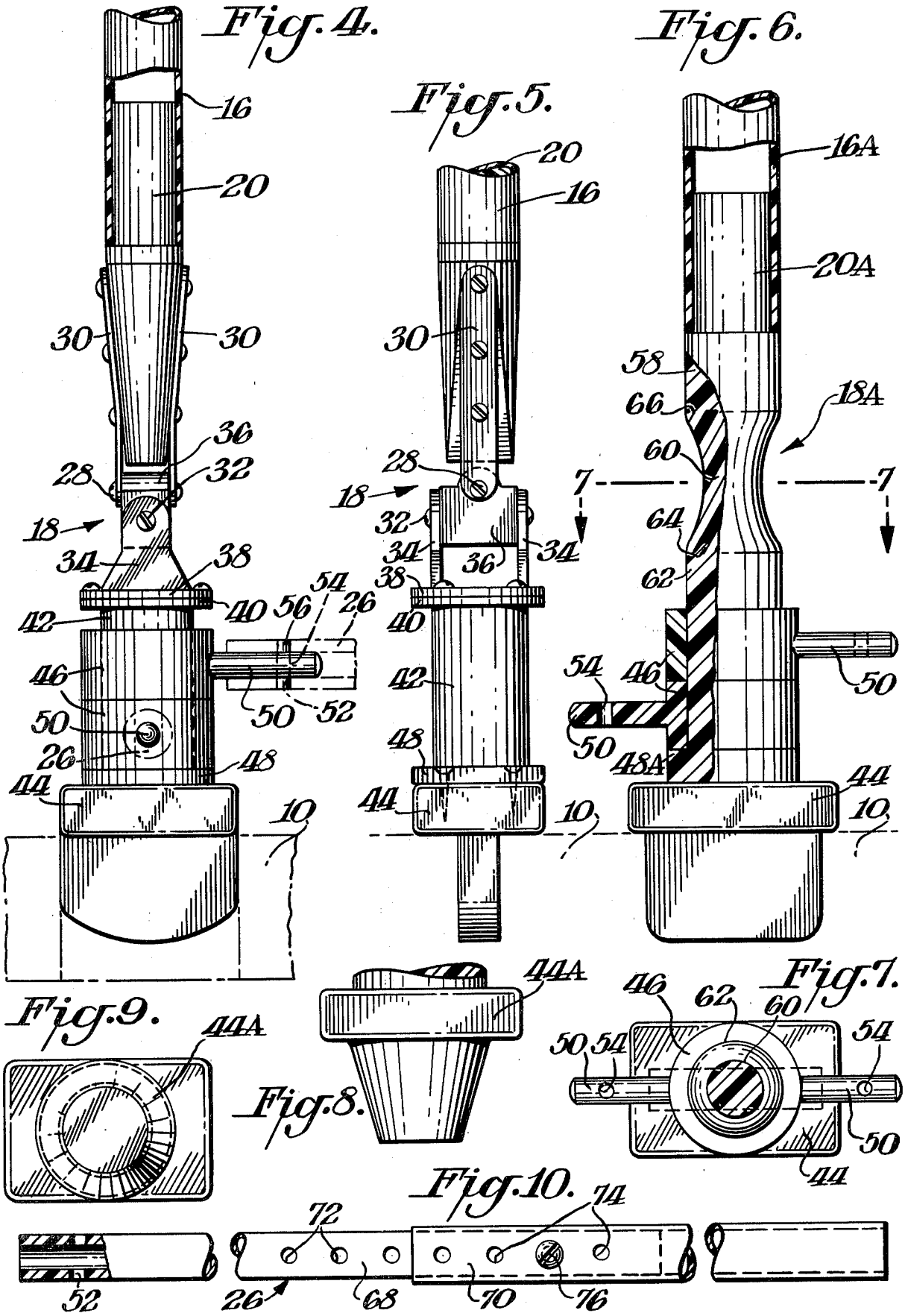
FIG. 4 is a front elevation view partly in section showing the connection of the mast plug to the deck plug with the connecting links and collars secured thereto as would be used in the embodiment of FIG. 1.
FIG. 5 is a side elevation view of the arrangement shown in FIG. 4 but with the collars omitted.
FIG. 6 is a front elevation view partly in section of an alternative universal joint for the mast.
FIG. 7 is a cross-sectional view taken through FIG. 6 along the line 7—7.
FIG. 8 is a front elevation view of a portion of a modified deck plug in accordance with one aspect of this invention.
FIG. 9 is a bottom plan view of the deck plug shown in FIG. 8.
FIG. 10 is an elevation view partly in section of a link usable in this invention.

The concepts of this invention may be practiced in various manners. FIGS. 4–5, for example, illustrate one such practice. As indicated therein, universal joint 18 is of known construction and includes, for example, a first horizontal pivot 28 effected by an axle through plates 30, 30 on each side of mast plug 20. A perpendicular pivot 32 is likewise achieved by an axle through plates 34, 34 on each side of pivot housing 36 with plates 34, 34 being secured to disc 38. Disc 39 in turn is mounted on lower disc 40 at the top of post 42 which is fastened in any suitable manner to deck plug 44. In the form shown in FIGS. 4–5, deck plug 44 is of a known T-shaped configuration.

FIG. 4 illustrates an embodiment of this invention wherein the sailboard is linked to two different sailboards. Such linking is achieved by mounting a collar 46 on top of flange 48 which in turn is secured to deck plug 44. Collar 46 would be of generally the same shape in plan view as flange 48.

As shown in FIGS. 4 and 6, collar 46 is made of a material which is sufficiently strong yet preferably soft enough so that it will effectively function in its intended manner while minimizing the possibility of causing injury should the user bump the collar. A suitable material, for example, would be a rubber-like material such as urethane elastomers commercially available by DuPont under the designations L-213 or L-167. Such materials resist repeated flexing and bending. In addition, a soft cuff of plastic foam such as, for example, a closed cell urethane foam, may be wrapped around the inboard end of connecting link 26 to prevent injury by squeezing between the board and the link. Each of the collars 46 shown in FIGS. 4 and 6 would be loosely mounted on its post so that it is freely rotatable. Each collar 46 includes an outwardly extending integral connecting pin 50 which is advantageously utilized for connecting the link 26 thereto. For example, in the illustrated embodiment, link 26 would have an aperture 52 (FIG. 10) extending completely therethrough for alignment with hole 54 (FIG. 6) in pin 50 so that the connecting pin 50 and line 26 can be connected together in any suitable manner such as by a shear pin 56 (FIG. 4). Where a sailboard is linked to only one other sailboard, one collar 46 would be used.

In te embodiment of the invention shown in FIGS. 4–5, collars 46 would be mounted on post 42 before disc 40 would be welded or otherwise secured to post 42. Preferably two or more collars would be mounted on post 42 even if the sailboard is linked to only one other sailboard so as to afford the ability for linking to a further sailboard.

FIGS. 6–7 illustrate a particularly advantageous practice of this invention wherein the universal joint 18A for the mast is formed in such a manner that the collars 46 may be easily assembled and disassembled. As indicated therein, the separate elements, which would correspond to the universal joint 18, to the mast plug 20, to the post 42 and to the various connectors of the FIGS. 4–5 embodiment, are instead made into a single element which generally comprises three sections 58, 60, 62 with the top and bottom sections 58, 60 being of a rigid material and with the intermediate section being of a less and semirigid material. Sections 58, 60, 62 would be molded in three stages. For example, section 62 would first be molded using a rigid material such as a suitable plastic or elastomer which could be adiprene, polystyrene or the like. Section 62 would end at transition area 64. Next a more flexible material having a greater degree of elasticity would be used to mold section 60. A suitable adiprene could also be used for section 60 to create a universal joint. In this process the rigid material for section 62 would be poured into the mold, and while that material is still tacky, the more flexible material would then be added to the mold up to transition area 66, and then the more rigid material would be again poured into the mold to create upper section 58 which also includes the mast plug 20A.

The one-piece universal 18A would also include a flange 48A which would be detachably secured to deck plug 44 in any suitable manner. The advantage of the one-piece universal is that it permits the ready assembly and disassembly of collars 46 should it be desired to add or replace collars. In this respect, all that is necessary is to detach mast 16 from mast plug 20A and to slide collars 46 on or off universal 18A Universal 18A should be capable of withstanding, for example, 10,000 flexures with the use of an adiprene section 60. Because of its construction, universal 18A can readily be replaced when necessary or desired.

FIG. 10 illustrates another feature of this invention which provides for the adjustability in the length of link 26. In this respect, link 26 is formed of a pair of telescopic tubular sections 68, 70 with sets of holes 72, 74 which may be aligned with each other so that the overall length of link 26 may be fixed by the insertion of a suitable connector 76 through respective sets of holes. Connector 76 could take any suitable form, such as a nut and bolt or a cotter pin or a shear pin. Similarly, connector 56 may also take any of these forms although a shear pin is preferred for joining link 26 to collar 46 since it would permit the sailboards to quickly separate in emergency conditions such as a large wake from power boats which could result in one surfer being thrown from his board.

FIGS. 8 and 9 show a further feature of this invention wherein a frusto-conical deck plug 44A is utilized rather than the T-shaped deck plug illustrated in FIGS. 4–7.

Figure 12:
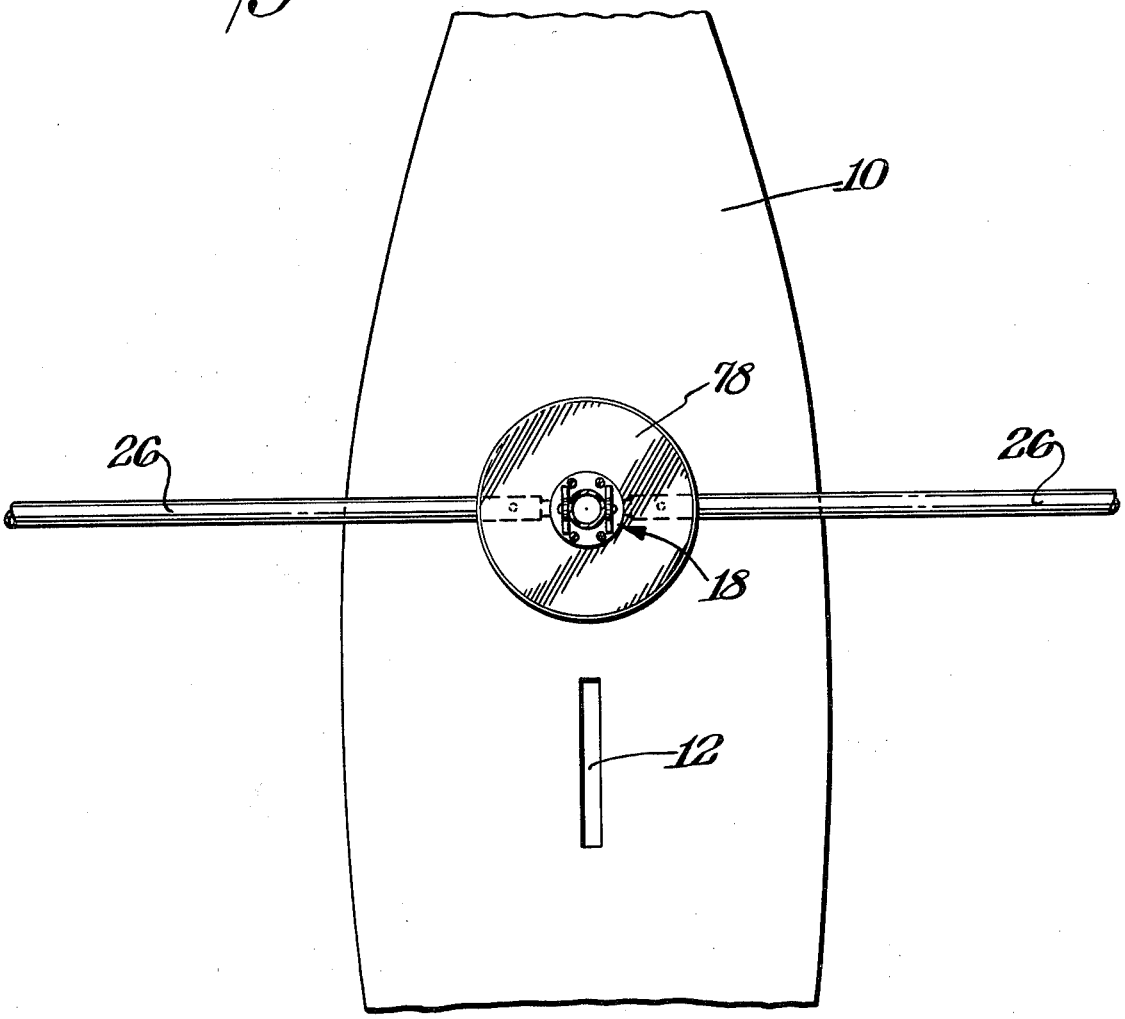
FIG. 12 is a plan view (with the user omitted) of the sailboard shown in FIG. 11.
Figure 11:
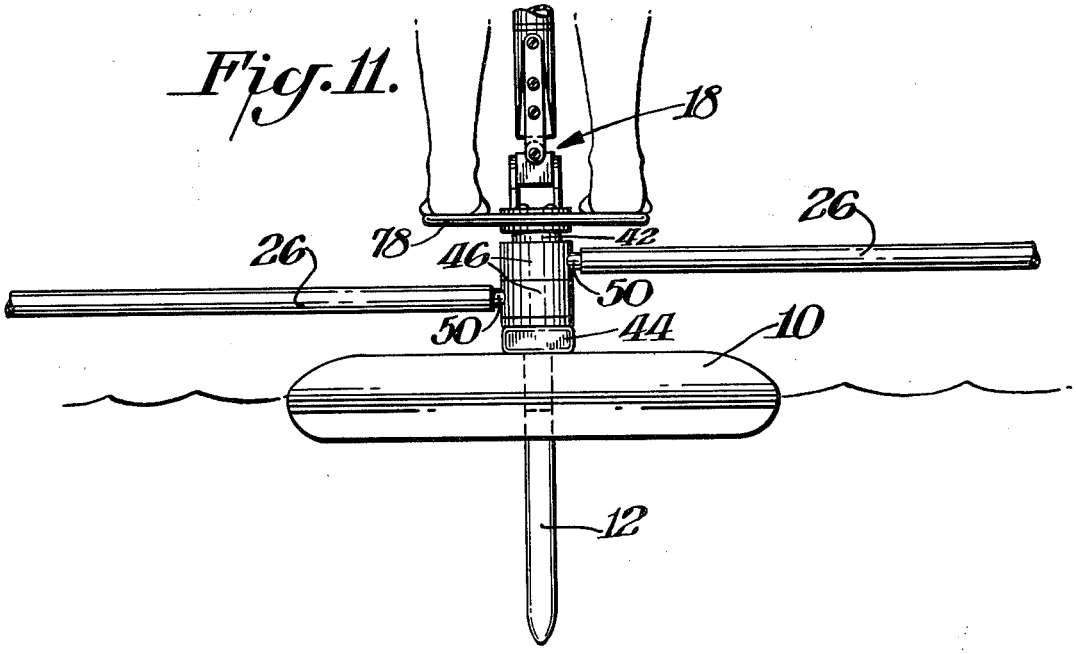
FIG. 11 is a rear elevation view of a portion of a sailboard in accordance with one ramification of this invention.

The collars 46 freely rotate under the mast swivel. In accordance with the relative positioning of pairs of sailboards, the position of link 26 with respect to hull 10, would also vary. Ordinarily the movement of link 26 would not be so sudden as to create problems for the surfer since the surfer could easily step over link 26 when either the surfer changes his position on hull 10 or the position of link 26 is changed. Under certain conditions, however, particularly under rapid and rough action or when certain manuevers are taking place, link 26 may move rapidly which could create the problems of the link striking the user. To obviate this problem, a platform 78 is provided as shown in FIGS. 11–12. As indicated therein, platform 78 is mounted above collars 46 between discs 38, 40. Platform 46 may take any suitable shape and may be of any suitable size as long as it is big enough to hold a user yet not so big as to add an obstacle to the user when the user stands on the hull. In the illustrated form of the invention, platform 78 is, for example, a disc concentrically mounted about the mast with a 4 inch radius which would provide such area to accommodate a user's foot on each side of the mast as shown in FIG. 11.

As previously indicated, the present invention is particularly advantageous in its adaptability to existing sailboards. Thus, any suitable dimension may be used for the best balance for the type of sailboards with which the invention is practiced. For example, where a sailboard having a hull 12 feet long is used, link 26 may be about 10 feet long. Link 26 would be made of any suitable material so that it is sufficiently flexible while still being rigid. One such material is adiprene L-213. Link 26, in the form shown in FIG. 10, could be 10 feet in its expanded length and 6 feet in its contracted length and preferably of a length so that the forward beam of the second sailboard should contact the aft beam of the first sailboard. Another suitable material for link 26 would be tubular polyethylene having an inner diameter of, for example, $\frac{1}{2}$ to $\frac{3}{4}$ inch and an outer diameter of 1 inch to $1\frac{1}{4}$ inches with the wall thickness being at least $\frac{1}{4}$ inch.

As can be appreciated, the present invention provides a completely new option in sailing: the modular multiple sail, multiple board assembly which can be quickly and easily assembled from standard sailboards owned by individuals. Advantageously the invention permits the users to select a link of any suitable length. Thus the length becomes a variable which can be the subject of further experiment by groups of people who wish to sail together to develop maximum speed from the aerodynamic interaction of their individually controlled sails.

By linking sailboards together, the boards can be arranged in various combinations. Each combination can be varied in terms of relative position of the units and the relative angles of the masts and sails so as to give the best speed in any given wind and sea condition. This freedom to seek out combinations which result in optimum speed is the essential ingredient in sailboat racing. It is applied in this concept in a completely novel way which will allow synergistic group activity and a whole new approach to team racing. There is much more room for individual and group expression in this new concept. However, its development is clearly not tied to racing: group cruising would be most pleasant and satisfying. The numbers of boards which can be joined are not limited. The mast step swivels can accept more than one arm, and thus, in theory, an almost infinite variety of units can be constructed. A cruise with two groups, each containing five sailboards, for example, linked in this way is easy to conceive once the idea of functional linkage is established.

What is claimed is:

1. A sailboard assembly comprising at least two sailboards, each of said sailboards having a hull with a daggerboard extending downwardly from said hull and with a deck plug extending upwardly from said hull and with a mast plug connected by a universal joint to said deck plug and with a mast connected to said mast plug and with a sail mounted to said mast and with a boom connected to said sail whereby the user may control the position of said sail by manipulating said boom, at least one semi-rigid link connected at each end to a respective sailboard whereby each link joins two sailboards together with the sailboards being capable of being spaced from each other, swivel means connecting each end of said link to its respective sailboard, said swivel means comprising a freely rotating collar mounted below said universal joint, and connecting means detachably connecting said collar to a respective end of said link.

2. The assembly of claim 1 wherein each swivel means being mounted to the foot of a respective mast, and with said link being detachably connected to said swivel means.

3. The assembly of claim 1 wherein said deck plug includes a frusto-conical section mounted to said hull.

4. The assembly of claim 1 includes a plurality of said collars stacked atop each other.

5. The assembly of claim 1 wherein said connecting means includes an outwardly extending connecting pin on said collar and a respective link being mounted to said connecting pin.

6. The assembly of claim 5 wherein the length of said link is adjustable.

7. The assembly of claim 6 wherein said link comprises a pair of telescopic tubes, and connecting means selectively joining said tubes together.

8. The assembly of claim 1 wherein said collar is made of a rubber-like material.

9. The assembly of claim 1 wherein said universal joint includes a lower rigid section and an upper rigid section which comprises said mast plug, and an intermediate section integral with said upper and lower sections and made of a more flexible material capable of flexing.

10. The assembly of claim 9 wherein said swivel means comprises at least one collar detachably and loosely mounted on said lower rigid section.

11. A sailboard assembly comprising at least two sailboards, each of said sailboards having a hull with a daggerboard extending downwardly from said hull and with a deck plug extending upwardly from said hull and with a mast plug connected by a universal joint to said deck plug and with a mast connected to said mast plug and with a sail mounted to said mast and with a boom connected to said sail whereby the user may control the position of said sail by manipulating said boom, at least one semi-rigid link connected at each end to a respective sailboard whereby each link joins two sailboards together with the sailboards being capable of being spaced from each other, swivel means connecting each end of said link to its respective sailboard, and including a platform mounted below said universal joint on which the user may stand.

12. An assembly for linking two sailboards together wherein each sailboard includes a deck plug and a mast plug connected by a universal joint to the deck plug, said linking assembly comprising a semi-rigid link made of a semi-rigid material and having a pair of free ends, a swivel means detachably connected to each of said free ends, each of said swivel means being adapted to be mounted to the foot of a mast, each of said swivel means being in the form of a collar adapted to be freely rotating when said collar is mounted below a respective universal joint, and connecting means detachably connecting said collar to a respective end of said link.

13. The assembly of claim 12 wherein said connecting means includes an outwardly extending connecting pin on said collar, and a respective one of ends of said link being detachably connected to said connecting pin.

14. The assembly of claim 13 wherein the length of said link is adjustable.

15. The assembly of claim 14 wherein said link comprises a pair of telescopic tubes, and connecting means selectively joining said tubes together.

16. The assembly of claim 12 wherein each of said universal joints includes a lower rigid section and an upper rigid section which comprises said mast plug, and an intermediate section integral with said upper and lower sections and made of a more flexible material capable of flexing.

17. The assembly of claim 16 wherein each of said collars is detachably and loosely mounted on said lower rigid section of its respective universal joint.

* * * * *